United States Patent [19]

Masot

[11] Patent Number: 4,698,621

[45] Date of Patent: Oct. 6, 1987

[54] CIRCUIT BREAKER PANELS WITH ALARM SYSTEM

[76] Inventor: Oscar Vila Masot, Doral Beach, Compejo Turistico "El Morro", Puerto La Cruz, Venezuela

[21] Appl. No.: 654,157

[22] Filed: Sep. 25, 1984

[51] Int. Cl.[4] ..... G08B 21/00

[52] U.S. Cl. ..... 340/639; 340/693; 340/638; 200/308

[58] Field of Search ..... 340/634, 638, 693, 628, 340/629, 630; 174/67; 200/61, 62, 308, 310

[56] References Cited

U.S. PATENT DOCUMENTS

| | | | |
|---|---|---|---|
| 1,988,689 | 1/1935 | Jackson | 200/61.62 |
| 2,460,758 | 2/1949 | Lawson | 340/638 X |
| 2,574,745 | 11/1951 | Langley | 200/61.62 X |
| 3,169,239 | 2/1965 | Lacey | 340/638 |
| 3,529,292 | 9/1970 | Neill et al. | 340/825.16 |
| 3,562,733 | 2/1971 | Murphy et al. | 340/638 |
| 3,662,369 | 5/1972 | Vinsani et al. | 340/638 |
| 3,670,301 | 6/1972 | Douglas | 340/65 |
| 3,683,350 | 8/1972 | Shedenheim | 340/638 |
| 3,816,827 | 6/1974 | Lynn, Jr. | 340/638 X |
| 4,358,810 | 11/1982 | Wafer et al. | 361/93 |
| 4,518,957 | 5/1985 | Wheeler | 340/639 |

FOREIGN PATENT DOCUMENTS

| | | | |
|---|---|---|---|
| 3028518 | 2/1981 | Fed. Rep. of Germany . | |
| 103897 | 3/1964 | Norway | 337/242 |

*Primary Examiner*—James L. Rowland
*Assistant Examiner*—Jeffery A. Hofsass
*Attorney, Agent, or Firm*—Jack Q. Lever, Jr.; Mitchell B. Wasson; Martin P. Hoffman

[57] ABSTRACT

An alarm system used in conjunction with a circuit breaker panel box indicating the presence of an overload condition. At least one sensor is provided in proximity with the circuit breaker box but is not physically connected thereto. This sensor senses various parameters which are inherent in an overload condition or which are produced by various circuitry connected to the circuit breaker which are enabled during an overload condition. This alarm system is set by closing the door of the circuit breaker panel box.

9 Claims, 4 Drawing Figures

FIG. 1.
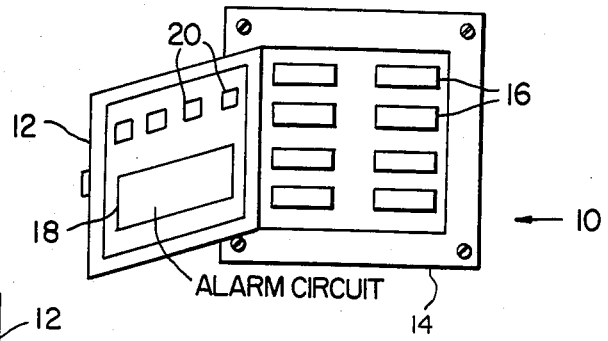
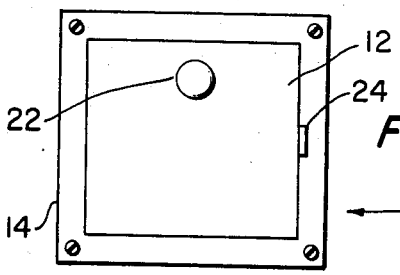
FIG. 2.
FIG. 3.
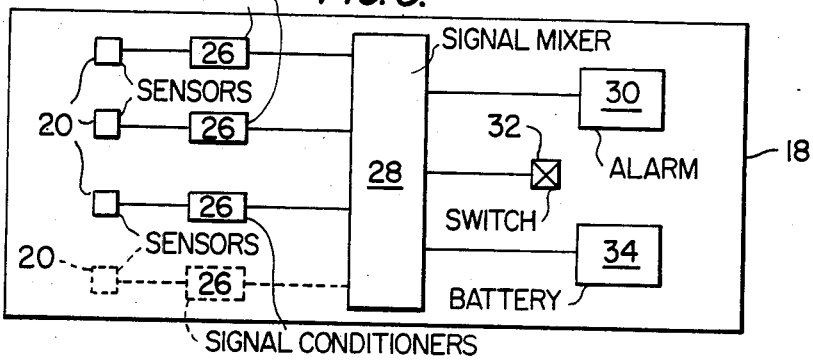
FIG. 4.
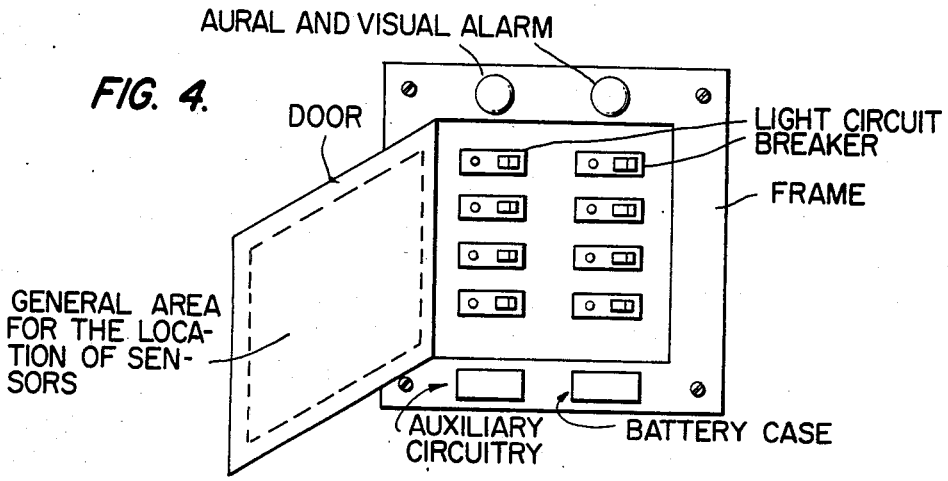

CIRCUIT BREAKER PANELS WITH ALARM SYSTEM

BACKGROUND OF THE INVENTION

Conventional circuit breakers are usually placed in operative position either singly or in banks of side-by-side units. These units can contain a handle which protrudes from the circuit breaker or a plurality of switches which are provided within the casing. When a number of such circuit breakers are in a group, as they conventionally are, it is often difficult to ascertain which circuit breaker has its handle or switch in a blown position, particularly since most circuit breakers are in cellars or in similar dimly-lit locations. In addition, even when the circuit breakers are in brightly-lit areas, it is often difficult to determine the particular circuit breaker which has blown. This, of course, is important since when an overload occurs and a circuit is blown, it must be found and corrected before resetting the circuit breaker, thereby considerably reducing the risk of life and material losses.

The prior art is replete with various devices containing a circuit breaker associated with a visual or aural indicator which positively shows which one of several circuit breakers has blown. One such device is described in U.S. Pat. No. 4,056,816 issued to Raul Guim, showing an illuminated circuit breaker utilizing a light-emitting diode to indicate when the circuit breaker has blown. This diode is provided in a circuit parallel to the main switch of the circuit breaker and when this switch is tripped due to the sensing of an overload condition, the light-emitting diode is connected into the circuit and begins to illuminate and remain lit until the problem is rectified. However, this patent does not disclose any means for sensing the presence of an overload condition other than by providing an indicating means directly connected into the circuit breaker circuit. Furthermore, the patent to Guim does not indicate the presence of any means for setting the alarm other than be directly connecting the circuit.

U.S. Pat. Nos. 2,460,758 issued to Lawson; 3,562,733 issued to Murphy et al; 3,683,350 issued to Shedenheim; 3,816,827 issued to Lynn, Jr. and 4,358,810 issued to Wafer et al all disclose circuit breakers having an alarm or other indication that a circuit has blown. For example, the patent to Lawson shows a lockout and alarm device for circuit breakers whereby the movement of a magnet causes a tripping alarm to rotate and thereby allow a movable contact to engage a stationary contact, thereby completing an alarm circuit whereby a lamp lights or a bell rings. Similarly, the patents to Murphy et al, Shedenheim, Lynn, Jr. and Wafer et al are provided with alarm circuits which are provided in a circuit which is physically connected to either a device for sensing that an overload has occurred or the device which is tripped when the overload is sensed. Additionally, although the patents to Lawson and Murphy et al also describe a device for manually setting the alarm circuit, neither of these patents discusses such a setting device which is provided between the circuit breaker door and the door frame.

SUMMARY OF THE INVENTION

The present invention overcomes all of the difficulties of the prior art by providing an alarm system for a circuit breaker which senses the change of light, sound, vibration, temperature or ionization level which is produced by a thermoelectric or magnetic circuit breaker sensing an overload condition and tripping the circuit breaker switch. More specifically, a plurality of sensors, each sensor associated with a single circuit breaker, sensitive to the parameters listed hereinabove are placed inside the circuit breaker panel box such that when any of a plurality of threshold levels are exceeded, as a result of the triggering of one or more of the circuit breakers inside the panel box, an audio, visual or additional signal or a combination thereof is produced. The sensors provided within the circuit breaker panel box are connected to an alarm means which is provided either directly in proximity with the circuit breaker panel box or at a distance from the electrical panel box in such a manner that an individual can perceive that one or more of the circuit breakers has been tripped and at the same time ensuring that the alarm signals cannot be damaged due to any problem within the electrical panel box.

The above and other objects, features and advantages of the present invention will become more apparent from the following description thereof taken in conjunction with the accompanying drawings.

BRIEF DESCRIPTION OF THE DRAWINGS

FIG. 1 is a front view of a standard electrical panel box having its door open;

FIG. 2 is a front view of a conventional electrical panel box having its door closed;

FIG. 3 is a block diagram showing the wiring of the sensors; and

FIG. 4 is a front view of an electrical panel box havings its door open showing a second embodiment of the present invention.

DETAILED DESCRIPTION OF THE INVENTION

FIGS. 1 and 2 show a conventional electric circuit breaker panel box 10 provided with a door 12 and a frame 14. Within the panel box is provided a series of circuit breaker switches 16. These circuit breakers are conventional in nature and could consist of either a thermoelectrically sensitive bimetallic sensing member or a magnetic armature and coil. In either case, when an overload condition is sensed, a tripping arm connected to either the bimetallic element or the magnetic armature moves to open a switch thereby disconnecting a load from the line current. A plurality of sensors 20 is provided on the door 12. These sensors could be utilized to sense the presence of a light directly connected to the circuit breaker circuit which is activated when an overload condition occurs. Additionally, the sensor could be sensitive to the noise and/or vibration impact produced by the triggering of one or more conventional circuit breakers when an overload or a short circuit occurs, or can be sensitive to the temperature level or ionization level which is present during an overload condition. Electrical circuitry 18 is directly provided on the door 12 and includes a battery therewith for powering the circuit. This circuit is conventional in nature but will be discussed in more detail with respect to FIG. 3.

FIG. 2 shows the panel door 12 closed and includes a set-reset switch which is set once the door is closed and can only be reset by opening the front door 12. This allows an individual to visually inspect which circuit breaker has been tripped, thereby alerting the individual to an electrical malfunction in that circuit, thus preventing or considerably reducing the risk of fire. The sensors 20 are connected through the electrical circuit 18 to an alarm 22 which can be either visual, aural or another kind of alarm. Stationary contacts are provided on the door frame 14 and movable contacts are provided on the door latch 24. When these contacts abut one another, the alarm system is engaged.

FIG. 3 represents a block diagram showing a possible circuit which can be utilized with the alarm device. This circuit contains a plurality of sensors 20 which are each connected to individual signal conditioners 26. It should be noted that although three sensors are shown in FIG. 3, the present invention can utilize any number of sensors. This provision is shown in FIG. 3 by depicting three sensors and signal conditioners in solid and a single sensor and signal conditioner in phantom. All of the signal conditioners are connected to a signal mixer 28 which is connected to an alarm device 30 which would alert an individual that one or more of the circuit breakers has been activated. A set-reset switch 32 is provided which is armed by closing the door 12. As shown in FIG. 2, the switch 32 is engaged when the door 12 is closed. A battery 34 is included for energizing this alarm system.

A second embodiment of the present invention is shown in FIG. 4 whereby the alarm circuitry and battery are provided on the door frame and not on the door. In this embodiment, a light sensor or a plurality of light sensors is mounted on the inside of the circuit panel door. The circuit panel includes a circuit breaker switch and a light-emitting diode or similarly illuminated lamp associated with each switch. This particular type of alarm circuit breaker is described in U.S. Pat. No. 4,056,816. The circuit breaker described therein includes a light-emitting diode which would be tripped by an overload or a short circuit. Furthermore, the aural and visual alarms are also provided on the door frame. In operation, when one or more of the circuit breakers is tripped by sensing an overload condition, the respective light-emitting diode associated with each switch would be illuminated. The light produced by these diodes is sensed by the light sensors provided on the door of the circuit breaker panel box. These sensors are connected to a visual or aural alarm which would be perceived by an individual. Connections from the light sensors provided on the inside of the door to the associated circuitry, alarm and battery will be made across the hinge edge of the door and protected from potential physical abuse. Similarly, sound or vibration sensors could be located inside the circuit breaker panel box for the purpose of detecting the noise and/or vibration impact produced by the triggering of one or more conventional circuit breakers when an overload or short circuit occurs. These sensors are connected to a circuit which is designed to discriminate against noise-vibration impulses extraneous to the triggering of the circuit breakers.

During operation of any one of the embodiments of the present invention, the alarm circuitry and sensors are set by closing the electrical panel box. Thus armed, the visual or aural alarms would not be disabled until the electrical panel box is reopened.

Many changes and modifications in the above embodiments of the invention can, of course, be made without departing from the scope of the invention. For example, it is apparent that although the present invention has been primarily described with respect to an electrical circuit breaker panel box having the various alarm devices connected in proximity with the circuit breaker, it is envisioned that this need not be the case. If desired, a panel or control board may be mounted in an area which is quite a distance from the circuit breaker panel box. In this situation, a guard or similar security personnel provided at the entrance to various facilities such as an apartment building or office building would monitor the status of the circuit breaker panel box.

What is claimed is:

1. An alarm system used in conjunction with conventional thermoelectrically or magnetically actuated circuit breakers provided in electrical panel boxes, each of the circuit breakers provided with a movable non-magnetic toggle switch, the system comprising:

sensing means provided in proximity with said circuit breakers but physically and electrically disconnected from said circuit breakers for sensing the occurrence of an abnormal circuit condition, said sensing means sensing the movement of the toggle switch from the ON to the TRIPPED position; and alarm means electrically connected to said sensing means for indicating the presence of an abnormal circuit condition at a position removed from the interior of the electrical panel boxes.

2. The alarm system in accordance with claim 1 further including:

alarm set-reset switch provided in the door and frame of said electrical panel box, said door provided with a movable contact and said frame provided with a fixed contact engaged by said movable contact when said door is closed.

3. The alarm system in accordance with claim 2 wherein said sensing means senses noise produced by the movement of the toggle switch of the circuit breaker.

4. The alarm system in accordance with claim 2 wherein said sensing means senses vibration produced by the movement of the toggle switch of the circuit breaker.

5. The alarm system in accordance with claim 1 wherein said sensing means senses noise produced by the movement of the toggle switch of the circuit breaker.

6. The alarm system in accordance with claim 1 wherein said alarm means is provided on the frame of said electrical panel box.

7. The alarm system in accordance with claim 1 wherein said alarm means is provided at a location remote from said electrical panel box.

8. The alarm system in accordance with claim 1 wherein said sensing means senses vibration produced by the movement of the toggle switch of the circuit breaker.

9. The alarm system in accordance with claim 1 wherein said sensing means is in an inactive state until it senses said abnormal circuit condition.

* * * * *